US005401147A

United States Patent [19]

Yu

[11] Patent Number: 5,401,147

[45] Date of Patent: Mar. 28, 1995

[54] AUTOMOTIVE FUEL PUMP WITH CONVERGENT FLOW CHANNEL

[75] Inventor: Dequan Yu, Ann Arbor, Mich.

[73] Assignee: Ford Motor Company, Dearborn, Mich.

[21] Appl. No.: 116,843

[22] Filed: Sep. 7, 1993

[51] Int. Cl.[6] ..... F04B 17/00

[52] U.S. Cl. ..... 417/423.14; 415/55.1

[58] Field of Search ..... 417/423.14; 415/55.1, 415/55.2

[56] References Cited

U.S. PATENT DOCUMENTS

| | | | |
|---|---|---|---|
| 1,920,484 | 8/1933 | Siemen et al. | 415/55.1 |
| 2,051,080 | 8/1936 | Frederick . | |
| 2,282,569 | 4/1939 | Fabig | 415/55.1 |
| 2,696,789 | 12/1954 | Fabig | 415/55.1 |
| 2,936,714 | 5/1960 | Balje | 415/55.1 |
| 4,478,550 | 10/1984 | Watanabe et al. . | |
| 4,804,313 | 2/1989 | Nasvytis | 415/55.1 |
| 5,009,579 | 4/1991 | Hauai et al. | 415/55.1 |
| 5,096,391 | 3/1992 | Tuckey | 417/423.14 |
| 5,192,184 | 3/1993 | Hobuo et al. | 415/55.1 |

FOREIGN PATENT DOCUMENTS

| | | | |
|---|---|---|---|
| 1331429 | 5/1963 | France . | |
| 0574323 | 4/1933 | Germany | 415/55.1 |
| 2104495 | 5/1979 | Germany | 415/55.1 |
| 0637885 | 4/1962 | Italy | 415/55.2 |
| 468590 | 7/1937 | United Kingdom | 415/55.1 |

*Primary Examiner*—Richard A. Bertsch
*Assistant Examiner*—M. Kocharov
*Attorney, Agent, or Firm*—David B. Kelley; Roger L. May

[57] ABSTRACT

A fuel pump has a motor which rotates a shaft with an impeller fitted thereon for pumping fuel within a pumping chamber comprised of a cover channel and a bottom channel formed in a pump cover and a pump bottom, respectively, which encase the impeller. The cover channel begins at a fuel inlet and runs circumferentially to a transition section near the opposite end where it gradually becomes narrower and shallower until becoming flush with the inner cover face. The fuel outlet in the bottom channel is positioned circumferentially 0°–5° beyond the end of and in partial fluid communication with the cover channel so that fuel is expelled smoothly from the cover channel through the fuel outlet.

14 Claims, 3 Drawing Sheets

AUTOMOTIVE FUEL PUMP WITH CONVERGENT FLOW CHANNEL

FIELD OF THE INVENTION

The present invention relates to an automotive fuel pump, and, more particularly, to a regenerative turbine fuel pump having a flow channel which becomes shallower and narrower toward the pump outlet.

BACKGROUND OF THE INVENTION

Regenerative turbine fuel pumps for automobiles typically operate by having a rotary element, for example an impeller, mounted on a motor shaft within a pump housing. A pumping chamber around the outer circumference of the rotary element is formed of two halves: a cover channel in the pump cover and a bottom channel in the pump bottom. Fuel drawn into a fuel inlet, located at the beginning of the cover channel and axially across from the beginning of the outlet flow channel, flows to either the cover channel or the bottom channel. Primary vortices are formed within each channel of the chamber by the pumping action of the rotary element and are propelled to the ends of each channel before being expelled through the fuel outlet, which is located at the end of the bottom channel. Pumping losses occur when primary vortices reach the end of the cover channel and must cross over to the fuel outlet. The shape of the cover channel becomes critical in properly dispelling pressurized fuel from the cover channel to the bottom channel and through the fuel outlet.

DESCRIPTION OF THE PRIOR ART

In prior art flow chambers, the cover channel maintains a constant depth until it is axially aligned with the fuel outlet. Thus, as shown in FIGS. 6 and 7, the cover channel 64 in pump cover 62 begins at fuel inlet 68 and runs circumferentially to channel end 76. Cover channel 64 neither narrows nor becomes shallower as it approaches outlet 60. As a result, primary vortices 65 abruptly stop at cover channel end 76, change direction 90°, and cross over primary vortices 59 before exhausting from fuel outlet 60. Pumping losses occur as a result of this cover channel design thus reducing pump efficiency.

The design of U.S. Pat. No. 4,478,550 (Watanabe et al.) provides a recess 104 in cover channel 94 axially opposite fuel outlet 90. As shown in attached FIGS. 8 and 9, primary vortices 95 flow into recess 104, make a 270° turn, and cross over to outlet 90. While perhaps decreasing undesirable forces on the impeller, this design has the drawback that crossing losses at the outlet still decrease pump efficiency.

SUMMARY OF THE INVENTION

The prior art discussed above does not suggest the advantageous gradual decrease of cover channel width and depth to smoothly guide fuel flow across the impeller to the fuel outlet without creating turbulence or crossing losses.

Thus, it is an object of the present invention to overcome the drawbacks of prior fuel pump designs by providing a fuel pump flow channel with a width and depth which gradually converge for better routing of fuel from the pumping chamber to the fuel outlet.

Another object of the present invention is to provide a fuel pump cover channel which reduces crossing losses between the primary vortices in the pumping chamber thus increasing pump efficiency.

Yet another object of the present invention is to provide a fuel pump cover channel which provides a smooth convergent path for primary vortices to exhaust through the pump outlet.

These objects are accomplished by providing a fuel pump for supplying fuel to an automotive engine, comprising a pump housing with a motor mounted within the housing having a shaft extending therefrom and a rotary pumping element for example, an impeller, fixedly attached to the shaft. A pump bottom mounted within the housing has a bore through which the shaft extends to the rotary pumping element. The pump bottom also has a bottom channel portion of an annular pumping chamber with a first end and a pump outlet at a second end thereof. A pump cover is mounted on an end of the housing and attaches to the pump bottom with the rotary pumping element therebetween. The pump cover also has a cover channel portion of an annular pumping chamber with a pump inlet, the pump cover and pump bottom cooperating to form a complete pumping chamber for the rotary pumping element. The cover channel extends circumferentially from the pump inlet to a transition section in which the width and depth of the cover channel gradually become narrower and shallower, respectively, such that the cover channel becomes flush with a rotary pumping element mating face of the pump cover and communicates partially with the fuel outlet.

In a preferred embodiment, the transition section extends along approximately a 15°–25° arc segment of the cover channel, and the transition section ends 0°–5° circumferentially from the center of the fuel outlet.

DETAILED DESCRIPTION OF THE PREFERRED EMBODIMENT

Figure 1:
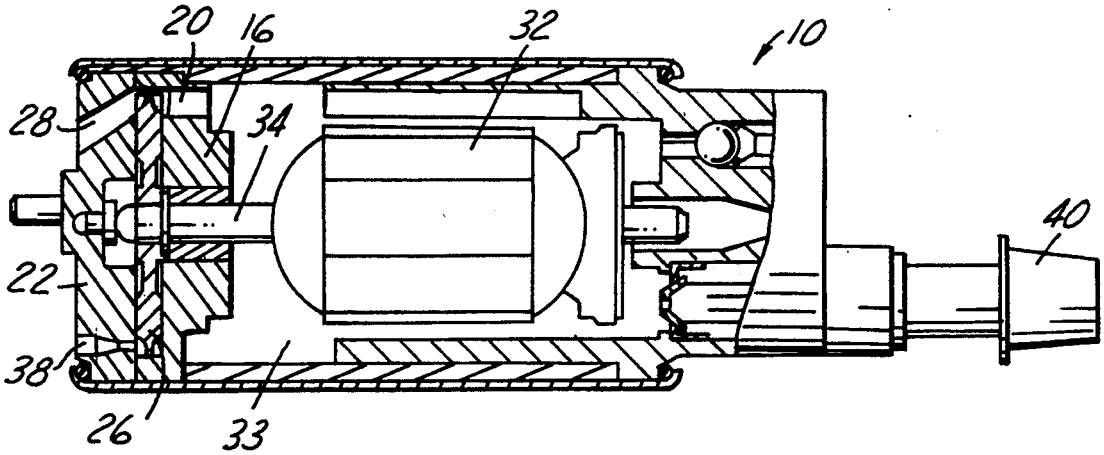
FIG. 1 is a cross-sectional view of a fuel pump according to the present invention.

Referring now to FIG. 1, a fuel pump 10 has a housing 14 for containing its inner components. A motor 32, preferably an electric motor, is mounted within motor space 33 for rotating a shaft 34 extending therefrom toward the left to a pumping section of the fuel pump 10, shown with greater detail in FIG. 2. A rotary pumping element, preferably an impeller 26, is fitted on shaft 34 and encased within a pump bottom 16 and a pump cover 22. Impeller 26 has a central axis which is coincident with the axis of shaft 34. Shaft 34 passes through a shaft opening 35 in pump bottom 16, through impeller 26, and into cover recess 12 of pump cover 22. Shaft 34 is journalled within bearing 37. Pump bottom 16 has a fuel outlet 20 leading from a pumping chamber 21 formed along the periphery of impeller 26 by an annular cover channel 24 of pump cover 22 and an annular bottom channel 18 of pump bottom 16. Pressurized fuel is discharged through fuel outlet 20 to motor space 33 and cools motor 32 while passing over it to pump outlet 40 at an end of pump 10 axially opposite inlet 28.

Fuel is drawn from a fuel tank (not shown), in which pump 10 may be mounted, through a fuel inlet 28 in pump cover 22, and into cover channel 24 or bottom channel 18 of pumping chamber 21 by the rotary pumping action of impeller 26. As impeller 26 rotates, primary vortices 25 and 19 (FIG. 5) are formed in cover channel 24 and bottom channel 18, respectively, and are propelled circumferentially around annular pumping chamber 21. Vortices 25 encounter a transition section 30 (FIG. 3) in which cover channel 24 gradually becomes narrower and shallower, thus forcing the fuel flow to converge toward the bottom channel 18 and, subsequently, to be expelled through fuel outlet 20.

Figure 3:
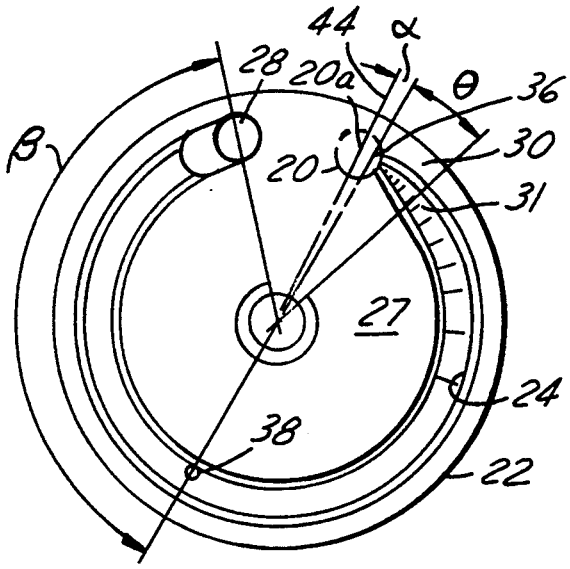
FIG. 3 is an inner view of a pump cover of the present invention taken along line 3—3 of FIG. 2 and shows a cover channel extending circumferentially from a fuel inlet to a transition section in which it gradually becomes narrower and shallower until it is flush with the face of the inner side of the pump cover.

Transition section 30 preferably extends along an angle $\theta$, as shown in FIG. 3, of approximately 15°-25° in which the depth of cover channel 24, as measured from the center of cover channel 24 to cover face 27, gradually decreases until cover channel 24 is flush with cover face 27 at cover channel end 36. Cover face 27 mates with impeller 26 when pump cover 22 and pump bottom 16 are combined. Cover channel 24 depth is approximately 0.5 to 2.0 mm from fuel inlet 28 to a transition beginning point 31 of transition section 30. The width of cover channel 24, which remains constant along its length beginning at fuel inlet 28 until transition beginning point 31, gradually narrows to a point at cover channel end 36. This gradual convergence of cover channel 28 provides a smooth path for vortices 25 to migrate toward fuel outlet 20 without the cross-over losses inherent in fuel flow channels axially adjacent the fuel outlet, such as those previously discussed. Cover channel 24 extends approximately 285°-295° from fuel inlet 28 to transition beginning point 31 (FIG. 3).

Figure 4:
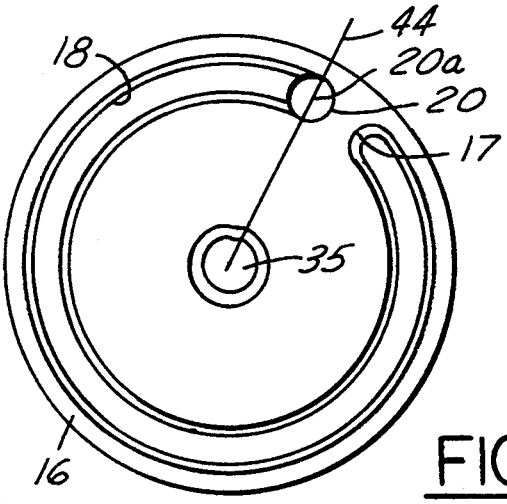
FIG. 4 is an inner view of a pump bottom of the present invention taken along line 4—4 of FIG. 2 and shows a bottom channel extending circumferentially from an end, which is axially aligned with the fuel inlet in the pump cover when the pump bottom is attached to the pump cover, to the fuel outlet.

In addition to a convergent cover channel 24, fuel outlet 20 position relative to cover channel end 36 is important for proper fuel flow. Fuel outlet 20 is advantageously located such that it partially overlaps cover channel 24 when pump cover 22 and pump bottom 16 are combined to form pumping chamber 21. Outlet center 20*a* of fuel outlet 20 is separated circumferentially from cover channel end 36 by an angle $\alpha$, with a range of 0°-5°, and preferably 2°-3°, as shown in FIG. 3. Fuel outlet 20 is of sufficient diameter such that, even with outlet center 20*a* separated from cover channel end 36 by angle $\alpha$, fuel outlet 20 overlaps axially with cover channel end 36 to allow fluid flow from cover channel 24 through fuel outlet 20. Line 44 shows the relative circumferential position of outlet center 20*a* to cover channel end 36 in both FIGS. 3 and 4. Outlet center 20*a* is positioned approximately 305°-315° circumferentially counterclockwise from fuel inlet 28.

Figure 5:
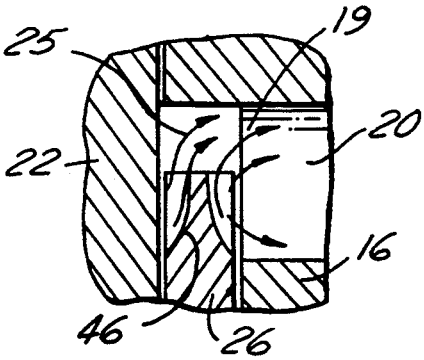
FIG. 5 is an enlarged cross-sectional view of a pumping chamber of the present invention taken along the center of the fuel outlet and schematically shows fuel flow out of the pump.
Figure 6:
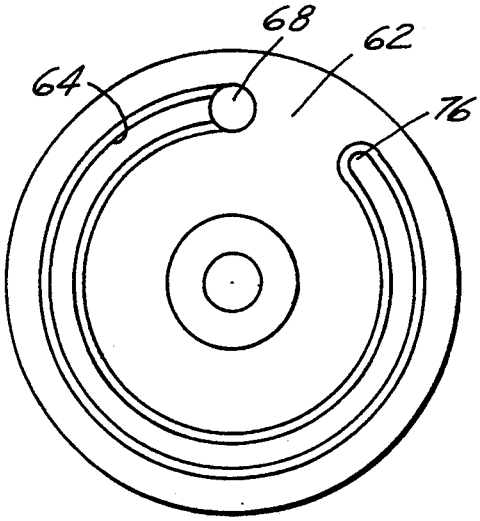
(PRIOR ART) FIG.6
FIG. 6 is an inner view of a prior art pump cover showing a cover channel extending circumferentially from a fuel inlet to the end of the cover channel.
Figure 8:
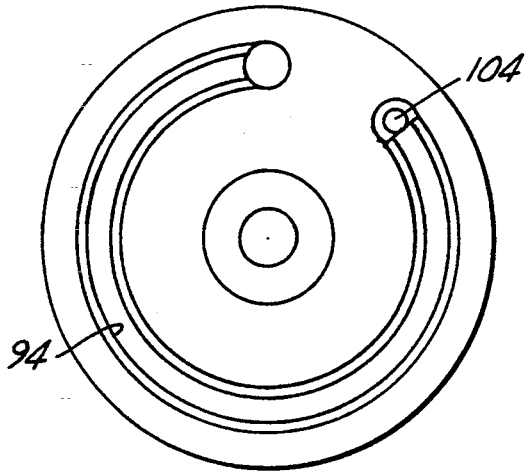
(PRIOR ART) FIG.8
FIG. 8 is an inner view of another prior art pump cover showing a cover channel extending circumferentially from a fuel inlet to the end of the channel.

With the construction of pumping chamber 21 just described, fuel is more efficiently pumped since cross-over losses at fuel outlet 20 are nearly eliminated, as shown in FIG. 5. Primary vortices 25 on impeller vane groove 46 smoothly pass over primary vortices 19 and through fuel outlet 20.

Figure 2:
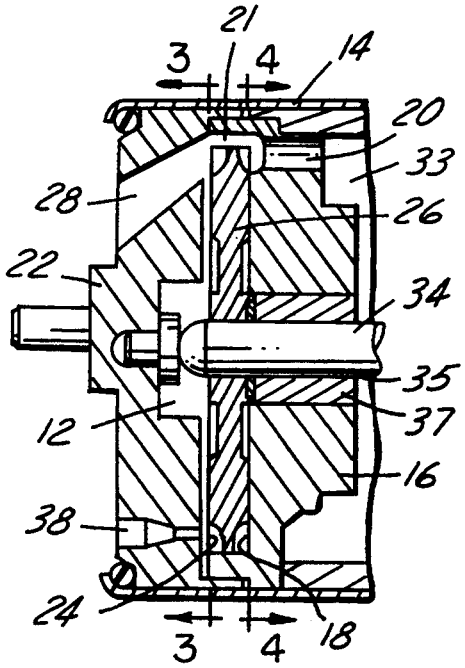
FIG. 2 is an enlarged partial cross-sectional view of the pump of FIG. 1.

As shown in FIGS. 2 and 3, purge orifice 38 is located in cover channel 24 to bleed fuel vapor from pumping chamber 21 so that vaporless liquid fuel reaches the engine (not shown). Purge orifice 38 extends axially through pump cover 22 at a radially inward portion of cover channel 24. Fuel vapor passes from pumping chamber 21, through purge orifice 38, and into the fuel tank (not shown). Preferably, purge orifice 38 is located approximately 100°-120° from fuel inlet 28 as shown by angle $\beta$ in FIG. 3.

Cover channel 24 can be die cast along with he pump cover 20, preferably in aluminum, or can be machined into pump cover 20. Alternatively, cover channel 24 and pump cover 22 can be integrally molded together out of a plastic material, such as acetyl or other plastic or non-plastic materials known to those skilled in the art and suggested by this disclosure.

Figure 7:
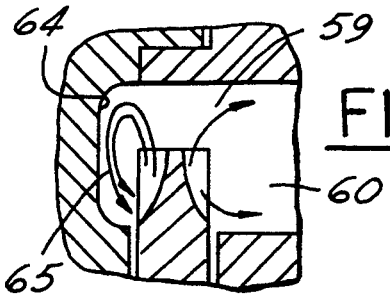
FIG.7 (PRIOR ART)
FIG. 7 is a cross-sectional view of the prior art pump cover of FIG. 6 showing the end of a cover channel axially aligned with the fuel outlet and schematically showing primary vortices in the cover channel of the pumping chamber.
Figure 9:
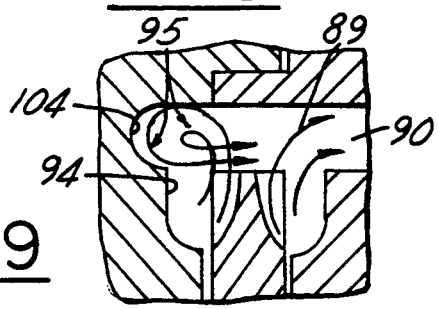
FIG.9 (PRIOR ART)
FIG. 9 is a cross-sectional view of the prior art pump cover of FIG. 8 showing the end of a cover channel with a recess axially aligned with the fuel outlet and schematically showing primary vortices in the cover channel section of the pumping chamber.
Figure 10:
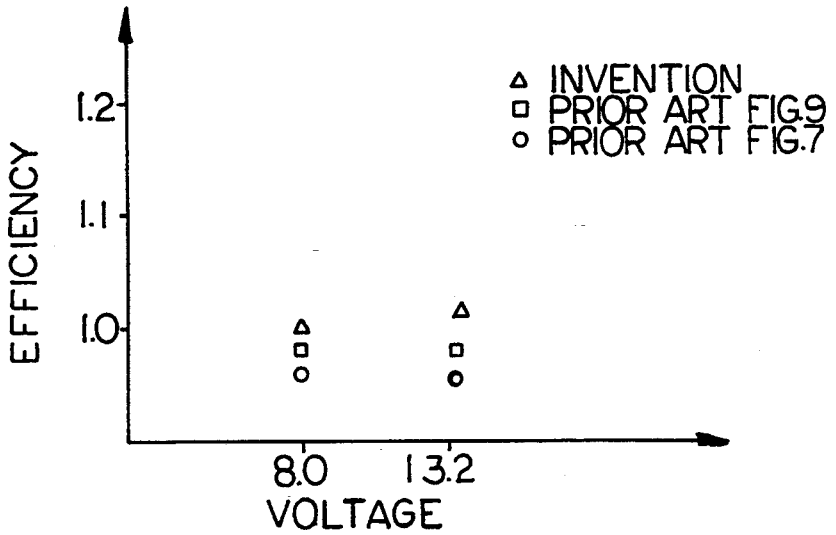
FIG. 10 is a graph comparing pump efficiency for the cover channel design of the present invention to that of the prior art designs depicted in FIGS. 6 through 9.
Figure 11:
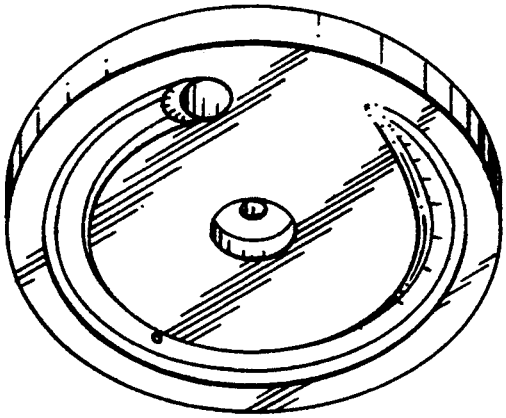
FIG. 11 is a perspective view of a pump cover according to the present invention showing a cover channel becoming shallower and narrows at an outler end thereof.

With fuel pump 10 of the present invention, pumping efficiency may be increased 10-15% from prior art pumps. FIG. 10 shows pumping efficiency for fuel pumps with the outlet configurations in FIGS. 7 and 9, as well as the current invention. Pumping efficiency for the present invention is higher under both 8.0 and 13.5 voltage operation.

Although the preferred embodiment of the present invention has been disclosed, various changes and modifications may be made without departing from the scope of the invention as set forth in the appended claims.

I claim:

1. A fuel pump for supplying fuel to an automotive engine, comprising:

a pump housing;

a motor mounted within said housing and having a shaft extending therefrom;

a rotary pumping element fixedly attached to said shaft;

a pump bottom mounted within said housing having a bore through which said shaft extends to said rotary pumping element, said pump bottom also having a bottom channel portion of an annular pumping chamber with a first end and a pump outlet at a second end thereof; and a pump cover mounted on an end of said housing and attached to said pump bottom with said rotary pumping element therebetween and having a cover channel portion of an annular pumping chamber with a pump inlet located at a radially equal distance from the center of said pump cover as said cover channel, said pump cover and pump bottom cooperating to form a complete pumping chamber for said rotary pumping element, with said cover channel extending circumferentially from said pump inlet to a transition section in which the width and depth of said cover channel gradually become narrower and shallower, respectively, such that said cover channel continuously tapers so as to become flush with a rotary pumping element mating face of said pump cover and partially overlaps axially with said fuel outlet.

2. A fuel pump according to claim 1, wherein said cover channel ends at a point circumferentially approximately 0°–5° before the axial center of said fuel outlet as projected onto said pump cover.

3. A fuel pump according to claim 1, wherein said transition section extends along approximately a 15°–25° arc segment of said cover channel.

4. A fuel pump according to claim 1, wherein said pump cover and said pump bottom are axially aligned such that said first end of said bottom channel is in axial alignment with said fuel inlet.

5. A fuel pump according to claim 1, wherein said cover channel has a depth of approximately 0.5–2.0 mm below an inner cover face at a beginning point of said transition section and rises to said mating cover face at an end of said transition section.

6. A fuel pump according to claim 1, wherein said transition begins at approximately 285°–295° circumferentially counterclockwise from the center of said fuel inlet.

7. A fuel pump according to claim 1, wherein said center of said fuel outlet is positioned at approximately 305°–315° circumferentially counterclockwise from the center of said fuel inlet.

8. A fuel pump according to claim 1, wherein a purge orifice extends axially through said pump cover from a radially inward portion of said cover race for expelling fuel vapor from said pump chamber, said purge orifice positioned at approximately 100°–120° circumferentially counterclockwise from the center of said pump inlet.

9. A fuel pump according to claim 1, wherein said rotary pumping element comprises a regenerative turbine.

10. A fuel pump for supplying fuel to an automotive engine, comprising:

a pump housing;

a motor mounted within said housing and having a shaft extending therefrom for rotation upon application of an electrical current to said motor;

a rotary pumping element fixedly attached to said shaft for rotatably pumping fuel;

a pump bottom mounted within said housing having a pump outlet therethrough and having a bore through which said shaft extends to said rotary pumping element, said pump bottom also having a bottom channel of an annular pumping chamber; and a pump cover mounted on an end of said housing and attached to said pump bottom with said rotary pumping element therebetween and having a cover channel of an annular pumping chamber with a pump inlet located at a radially equal distance from the center of said pump cover as said cover channel, said pump cover and pump bottom cooperating to form a complete pumping chamber for said rotary pumping element, with said cover channel extending circumferentially approximately 285°–295° from said pump inlet to a transition section in which the width and depth of said cover channel gradually become narrower and shallower, respectively, such that said cover channel continuously tapers so as to become flush with a rotary pumping element mating face of said pump cover and ends at a point circumferentially approximately 0°–5° before the axial center of said fuel outlet as projected onto said pump cover such that said fuel outlet partially overlaps axially with said cover channel to smoothly route fuel flow from said pumping chamber to said pump outlet.

11. A fuel pump according to claim 10, wherein said transition section extends along approximately a 15°–25° arc segment of said cover channel.

12. A fuel pump according to claim 10, wherein said center of said fuel outlet is positioned at approximately 305°–315° circumferentially counterclockwise from the center of said fuel inlet.

13. A fuel pump according to claim 10, wherein a purge orifice extends axially through said pump cover from a radially inward portion of said cover race for expelling fuel vapor from said pumping chamber, said pure orifice positioned at approximately 100°–120° circumferentially counterclockwise from the center of said pump inlet.

14. A fuel pump according to claim 10, wherein said rotary pumping element comprises a regenerative turbine.

* * * * *